US009211995B2

(12) United States Patent
Werner et al.

(10) Patent No.: US 9,211,995 B2
(45) Date of Patent: Dec. 15, 2015

(54) POUCH AND VALVE ASSEMBLY PACKAGE FOR CONTAINING AND DISPENSING A FLUENT SUBSTANCE

(75) Inventors: Jonathan D. Werner, Algonquin, IL (US); Mark G. Neuhalfen, Mount Prospect, IL (US); Gerald J. Marquardt, Elgin, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/350,832

(22) PCT Filed: Nov. 3, 2011

(86) PCT No.: PCT/US2011/059104

§ 371 (c)(1),
(2), (4) Date: Apr. 10, 2014

(87) PCT Pub. No.: WO2013/066328

PCT Pub. Date: May 10, 2013

(65) Prior Publication Data

US 2014/0252030 A1 Sep. 11, 2014

(51) Int. Cl.

| | |
|---|---|
| ***B65D 35/00*** | (2006.01) |
| ***B65D 83/62*** | (2006.01) |
| ***B65D 33/00*** | (2006.01) |

(52) U.S. Cl.

CPC ..... *B65D 83/62* (2013.01); *B65D 33/00* (2013.01)

(58) Field of Classification Search

CPC ..... B65D 33/00; B65D 31/02; B65D 31/06; B65D 31/08; B65D 31/10; B65D 35/00; B65D 35/02; B65D 35/08; B65D 83/62

USPC ..... 222/95, 92, 100, 386.5; 383/120, 121, 383/121.1, 104, 106, 123, 80

See application file for complete search history.

(56) References Cited

U.S. PATENT DOCUMENTS

| | | | | |
|---|---|---|---|---|
| 4,886,674 | A | 12/1989 | Seward et al. | |
| 5,169,037 | A * | 12/1992 | Davies et al. | 222/402.1 |
| 8,328,047 | B2 * | 12/2012 | Walters et al. | 222/95 |
| 2003/0230604 | A1 | 12/2003 | Huffer | |

(Continued)

OTHER PUBLICATIONS

The "International Search Report and Written Opinion of the International Searching Authority, or the Declaration" dated "Mar. 21, 2012" for the International Application No. PCT/US2011/059104 of which the above-captioned instant U.S. Appl. No. 14/350,832 is a U.S. national phase application.

(Continued)

*Primary Examiner* — Lien Ngo

(74) *Attorney, Agent, or Firm* — Wood, Phillips, Katz, Clark & Mortimer

(57) ABSTRACT

A package (52) is provided for containing and dispensing a fluent product. The package (52) defines a longitudinal axis (23), and includes a fitment body (18), and a collapsible pouch (12) for containing a fluent product to be dispensed, the pouch (12) defined by at least two opposing, flexible, web portions (24), and gusset portion (42). The fitment body (18) extends from a dispensing end (33) of the pouch (12) with the fitment body (18) being sandwiched between the flexible web portions (24), and the flexible web portions (24) being welded to each other and to the fitment body (18) at an end seal (32). An improved, robust corner seal construction (54) is provided where each of the flexible web portions (24) is joined to the gusset portion (42).

6 Claims, 4 Drawing Sheets

(56) References Cited

U.S. PATENT DOCUMENTS

| | | | |
|---|---|---|---|
| 2005/0173455 | A1 | 8/2005 | Hagihara |
| 2010/0308077 | A1 | 12/2010 | Sonntag |
| 2011/0101025 | A1 | 5/2011 | Walters et al. |

OTHER PUBLICATIONS

SeaquistPerfect Dispensing drawing C99-ABS-F3. Rev. A bearing a "Drawn By" Date of Aug. 6, 2008.

* cited by examiner

POUCH AND VALVE ASSEMBLY PACKAGE FOR CONTAINING AND DISPENSING A FLUENT SUBSTANCE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

TECHNICAL FIELD

This invention relates to packages for containing a fluent product wherein the package includes a collapsible pouch and a fitment body or assembly for dispensing the fluent product, and more particularly to such a package having improved strength for use in a pressurized container.

BACKGROUND OF THE INVENTION AND TECHNICAL PROBLEMS POSED BY THE PRIOR ART

Collapsible pouches are typically used for packaging a wide variety of products involving food, beverages, personal care products, household care products, or other similar or dissimilar products which may be in the form of a liquid, lotion, gel, paste, or the like. Such a pouch is typically made from a flexible, heat-sealable, polymeric sheet or from a flexible, paperboard or metal foil sheet having a heat-sealable, polymeric lining. The pouch typically has two, opposed, flexible web portions peripherally sealed or joined to one another so as to define an interior region, which is adapted to contain the fluent product, and also to define an opening for establishing communication between the pouch interior region and the exterior of the pouch. The pouch may include a lower gusset which joins the two, opposed flexible webs, to increase pouch volume. The opening in the pouch is adapted to receive a dispensing fitment assembly, which may incorporate a dispensing valve, and a removable cover, dispensing actuator or other similar or dissimilar features, and which typically further includes a fitment body molded from a polymeric material that can be heat-sealed to the web portions of the collapsible pouch. Such constructions are commonly referred to as Bag-On-Valve ("BOV") packages. Some examples of BOV packages can be seen in U.S. Pat. No. RE 39,520 E, issued Mar. 20, 2007; U.S. Pat. No. 6,439,429, issued Aug. 27, 2002; and U.S. Pat. No. 6,272,307, issued Aug. 14, 2001, all hereby incorporated by reference.

It is known to utilize such BOV packages in dispensing systems that utilize a container that is pressurized with a propellant or compressed gas. In such pressurized systems, the pouch of the BOV package is inserted into a pressure capable container with a portion of the fitment assembly engaging an insertion opening of the container to close the container with the pouch hanging from the fitment assembly inside the container. Examples of such dispensing systems can be seen in U.S. Pat. No. Re. 35,540, issued Jun. 24, 1997 and in U.S. Pat. No. 5,169,037, issued Dec. 8, 1992, all hereby incorporated by reference. The weight of the fluent product contained in the collapsible pouch is known to cause stresses in the web portions of the pouch at the lower gusset thereof, particularly at the so-called triple point gusset weld, that is, those points of the pouch at which the lower gusset is joined to the two opposed flexible webs. Such stresses can occur particularly when the pressurized dispensing system is subjected to impact loads such as when being dropped from a height onto a hard surface. These stresses have been known to cause failures in BOV packages and there is a continuing need to make such constructions more robust in order to reduce such failures.

SUMMARY OF THE INVENTION

In accordance with the present invention, a package is provided for containing and dispensing a fluent product. The package includes a fitment body defining a dispensing passage, and a collapsible pouch having a longitudinal axis for containing a fluent product to be dispensed. The pouch is defined by two opposing, flexible web portions, and a flexible gusset portion.

The fitment body is located at a dispensing end of the pouch, and is sandwiched between the flexible web portions. The web portions are joined to each other to define a pair of laterally spaced, longitudinally extending edge seals, and are further joined to each other and to the fitment body to define an end seal extending laterally across the pouch at the dispensing end thereof.

In accordance with the present invention, the flexible web portions are joined to the flexible gusset portion opposite of the dispensing end of the pouch. A first section of the gusset portion is directly joined to one of the flexible web portions at a pair of laterally spaced corner seals, and a second section of the gusset portion is directly joined to the other of the flexible web portions by another pair of laterally spaced corner seals.

In accordance with the present invention, the pouch of the present package is configured to exhibit enhanced strength and robustness by the configuration of the corner seals joining the gusset portion of the pouch to each of the flexible web portions. In particular, each of the corner seals includes a first edge seal portion extending from a respective one of the edge seals of the pouch, in parallel relationship to the longitudinal axis thereof. A second seal portion of each corner seal extends inwardly from the first edge seal portion, while a third seal portion extends from the second seal portion either: (1) in parallel relationship to the longitudinal axis of the pouch, with the third seal portion spaced inwardly of the respective first seal portion; or (2) outwardly toward the respective first seal portion.

In the preferred form, each second seal portion of each corner seal includes a linear segment that extends at an acute angle relative to the longitudinal axis of the pouch. Preferably, this linear segment of each corner seal extends at an acute angle between about 25 to 50 degrees relative to the longitudinal axis of the pouch.

In accordance with the illustrated embodiment, each of the second seal portions of each of the corner seals has a transition segment that preferably extends in substantially perpendicular relationship from the respective first seal portion. The respective linear segment of each second seal portion extends at the acute angle from the respective one of the transition segments to the respective third seal portion of that corner seal. Preferably, each of the second seal portions of each of the corner seals is spaced from about two to four millimeters from the respective one of the longitudinally extending edge seals.

Other objects, features, and advantages of the invention will become apparent from a review of the entire specification, including the appended claims and drawings.

BRIEF DESCRIPTION OF THE DRAWINGS

FIG. 4 shows the third seal portion 66, 66A in two alternate configurations.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention and the container employed with the components of this invention are described in the normal (upright) operating position. Terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed description of such elements is not necessary to an understanding of the invention, and accordingly, is herein presented only to the degree necessary to facilitate an understanding of the novel features of the present invention.

The present invention is directed to a Bag-On-Valve package construction which is configured to exhibit improved strength and resistance to rupture. This type of package includes an inner collapsible pouch joined to an associated fitment assembly. The fitment assembly includes a valve assembly for dispensing a fluent product, a fitment or valve body for mounting the valve in a dispensing passage, and a dip tube extending from the passage of the fitment body into a lower portion of the interior of the associated pouch. The fitment assembly includes a mounting cup for mounting the package to a filling opening of an associated pressure capable container. In a typical configuration, the dispensing passage of the fitment assembly, the valve assembly, and dip tube extend along a longitudinal axis of the package.

In a typical configuration, the collapsible pouch includes two opposing, flexible web portions joined by a pair of laterally spaced, longitudinally extending edge welds or seals. A laterally extending top or end weld or seal is located at an upper, dispensing end of the pouch with the end weld formed by welding the flexible web portions to each other, and to the fitment body. In accordance with the present invention, the pouch includes a lower gusset, as will be further described. Welds for the pouch can be formed using a variety of methods, including heat induction, heat conduction, ultrasonic welding, friction welding, and the like.

Figure 1:
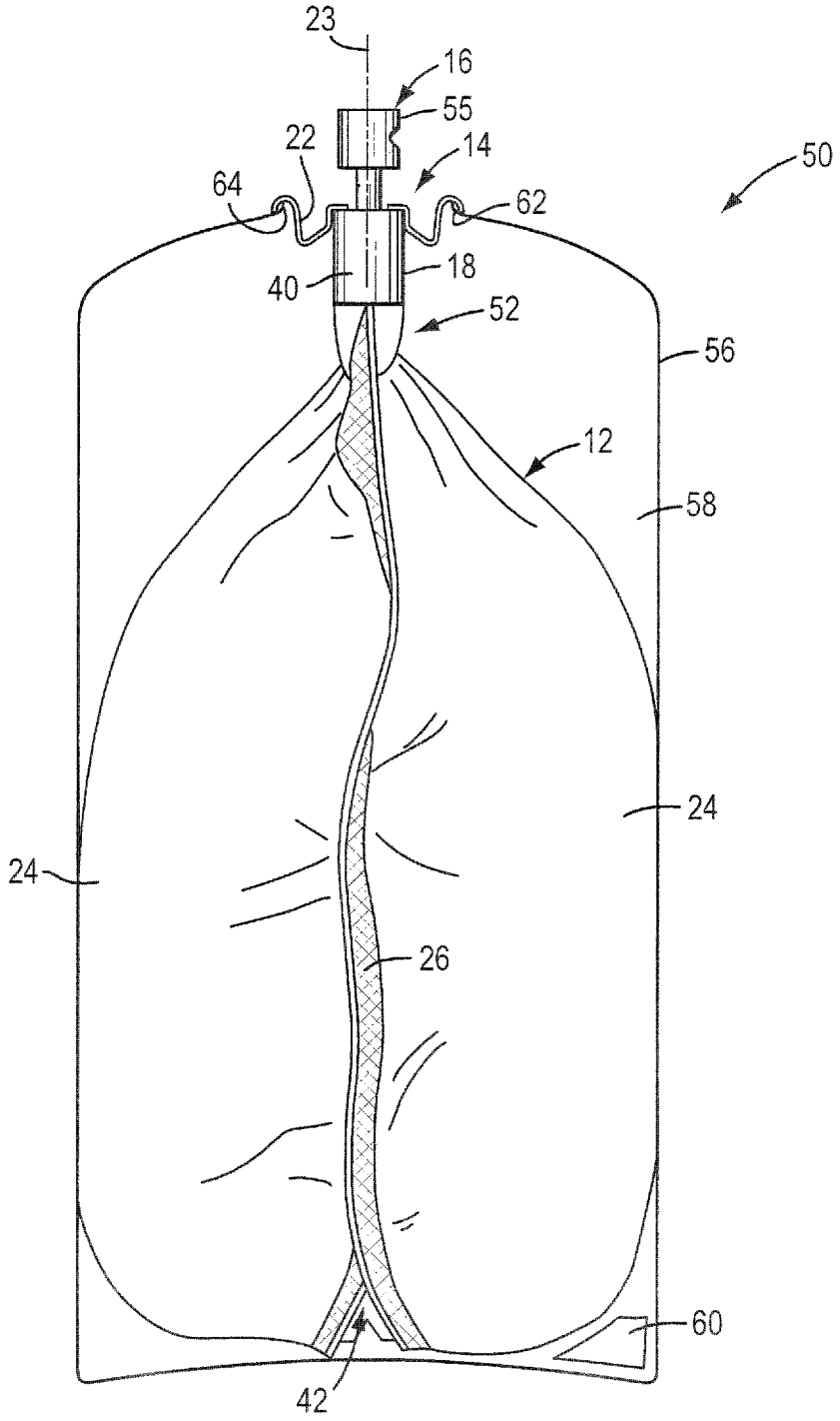
FIG. 1 is an illustration of a pressurized dispensing unit incorporating a Bag-On-Valve package containing a product to be dispensed and embodying the present invention wherein the package is installed in a pressurized container, which is shown diagrammatically.
Figure 2:
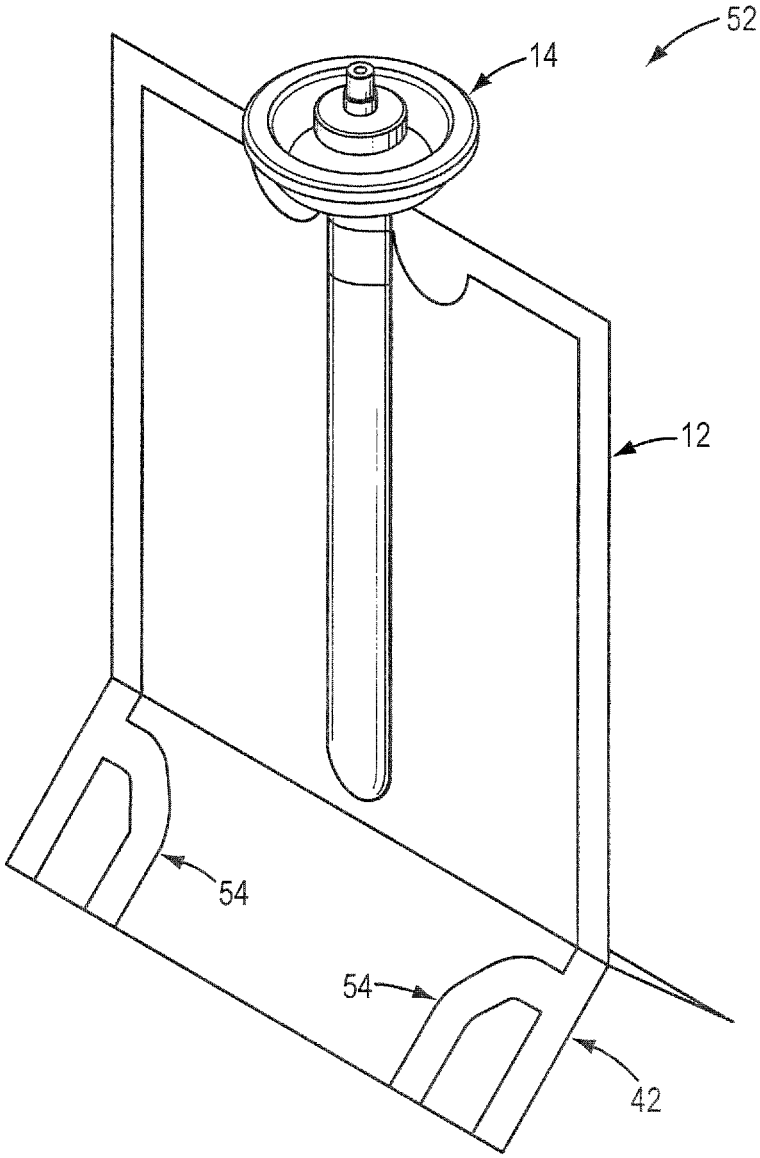
FIG. 2 is an isometric view of the Bag-On-Valve package (prior to being filled with product) embodying the present invention.

FIG. 1 illustrates a pressurized dispensing unit 50 including a Bag-On-Valve package 52 that has been filled with a product to be dispensed, and that has robust corner seals embodying the present invention. The package 52 includes a collapsible pouch 12 and a fitment assembly 14, as previously described. In this regard, pouch 12 and fitment assembly 14, including dispensing valve 16 (shown in FIG. 1 with a spray nozzle 55), a fitment body 18 having a lower end or tailpiece 40, a dip tube 20 (not visible in FIG. 1), and the mounting cup 22, can be of any suitable configuration, many of which are known, as dictated by the particular application intended for the dispensing unit 50.

The unit 50 includes a pressure capable container 56 having an interior chamber 58 for the pouch 12 and a propellant, shown schematically at 60. The container 56 and propellant 60 can be of any suitable type or construction (many of which are known) as dictated by the requirements of each particular application. The pouch 12 and tailpiece 40 of fitment assembly 14 of the package 52 are assembled into the container in a standard fashion by rolling the empty pouch 12 into a generally cylindrical form and then inserting the pouch 12 and tailpiece 40 through an insertion opening 62 of the pressure capable container 56, with the mounting cup 22 being sealably attached to a rim 64 of the container 56 surrounding the opening 62 using any suitable means of attachment, many of which are known. After the pouch 12 is assembled into the container 56, the container can be pressurized with propellent 60, and the fitment assembly 14 sealingly joined to the container 56. Fluent product can thereafter be loaded into the pouch 12 via the valve assembly 16. The fluent product may be a food, beverage, personal care product, household product, safety product, or other similar or dissimilar product in the form of a liquid, gas, suspension, paste, gel, powder, particles, etc.

The collapsible pouch 12, which can be of a conventional configuration apart from the improved seal construction of the present invention, is typically and preferably made from a flexible, heat sealable, polymeric sheet or from a multi-layer laminate including a flexible, paperboard or metal foil sheet having a heat-sealable, polymeric lining so as to have two opposing, flexible web portions that are heat sealed or otherwise joined to one another at their peripheral edges to define an interior region for containing the fluent product. The multi-layer laminate can be an extrusion-laminated film or an adhesive-laminated film. The layers of the laminate may include a gas barrier layer, a thermal stability layer, and the like, along with appropriate bonding layers bonding the various layers together.

In accordance with the present invention, robust corner seals or welds 54 of a package embodying the present invention will now be described. The web portions 24 and the gusset portion 42 may be formed form a single piece of sheet material, or two or more separate sheets of material.

In accordance with the illustrated embodiment, collapsible pouch 12 has a longitudinal axis 23, and is configured for containing a fluent product to be dispensed. To this end, the pouch is defined by two opposing, flexible web portions 24, and a flexible lower gusset portion 42.

The fitment body 18 is located at a dispensing end of the collapsible pouch 12, and is preferably sandwiched between the flexible web portions 24, and is joined thereto by an end seal 32 extending laterally across the pouch 12 at the dispensing end 33 thereof. The flexible web portions 24 are joined to each other to define a pair of laterally spaced, longitudinally extending edge seals 26.

The flexible web portions 24 are joined to the flexible gusset portion 42 opposite of the dispensing end 33 of the pouch 12, with the gusset portion 42 typically folded at a gusset fold line 43. A first section, generally one half, of the gusset portion 42 is directly joined to one of the flexible web portions 24 at a pair of laterally spaced corner seals 54, configured in accordance with the present invention. A second section of the gusset portion 42 is directly joined to the other of the flexible web portions 24 by another pair of laterally spaced corner seals 54.

Each of the corner seals 54, typically provided in the form of a heat-seal or weld, has been particularly configured to enhance the strength of the collapsible pouch 12. In particular, each of the corner seals 54 includes a first edge seal portion 60 extending from a respective one of the edge seals 26 of the pouch in parallel relationship to the longitudinal axis thereof. Each corner seal 54 further includes a second seal portion, comprising a transition segment 63 and an angled linear segment 64, wherein the second seal portion extends inwardly from the first edge seal portion 60.

Figure 4:
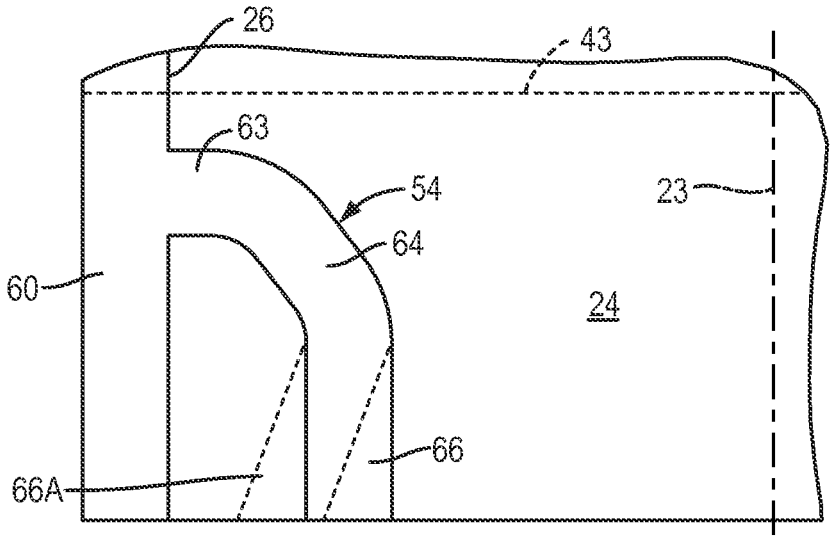
FIG. 4 is a relatively enlarged, fragmentary side elevational view of the Bag-On-Valve construction according to the present invention.
Figure 5:
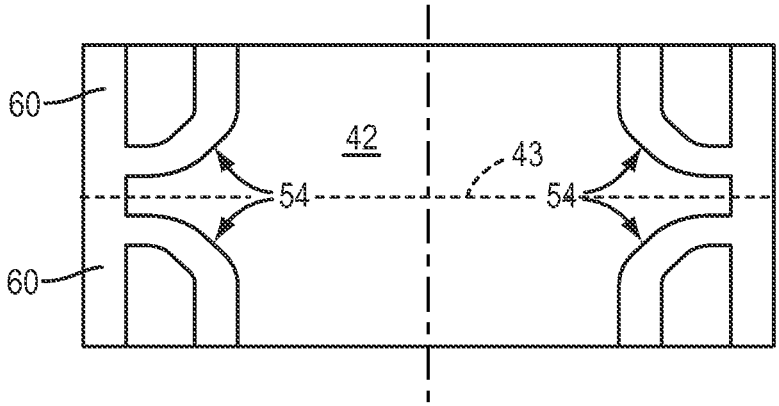
FIG. 5 is a bottom plan view of the present Bag-On-Valve construction according to the present invention with the gusset unfolded to a flat orientation.

In accordance with the present invention, each corner seal 54 further includes a third seal portion 66, extending from the linear segment 64 of the second seal portion, wherein the third seal portion 66 extends either: (1) in parallel relationship to the longitudinal axis of the pouch, and is spaced inwardly of the respective first edge seal portion 60 (see FIG. 4); or (2) outwardly toward the respective first seal portion 60 (see this alternate configuration of third seal portion 66A in FIG. 4). As illustrated, it is presently preferred that each third seal portion 66 extends in parallel relationship to the longitudinal axis, and is spaced inwardly of the respective first edge seal portion 60. Preferably, each corner seal 54 is suitably radiused where the transition segment 63 is joined to angled linear segment 64, and where the linear segment 64 joins the third vertical seal portion 66.

Notably, this configuration of each corner seal 54 has been found to provide the collapsible pouch 12 with enhanced strength, whereby the use of less expensive materials can desirably be employed for manufacture of the pouch. In actual practice, using materials like those in previous constructions, a pouch 12 having corners seals 54 in accordance with the present invention was capable of withstanding up to 5 (five) repetitions of a standardized horizontal drop test (during which a pressurized container with a filled pouch therein is dropped in a horizontal orientation a vertical distance of 1.6 meters), while a like container having a pouch with conventional corner seals exhibited failure and leakage of the pouch after five repetitions of such a drop test.

In accordance with the preferred form, the angled linear segment 64 of each of the second seal portions of the corner seals 54 extends at an acute angle "alpha" ($\alpha$ in FIG. 3) relative to the longitudinal axis of the pouch. In the preferred embodiment, this acute angle is between about 25 to 50 degrees relative to the longitudinal axis of the pouch.

Figure 3:
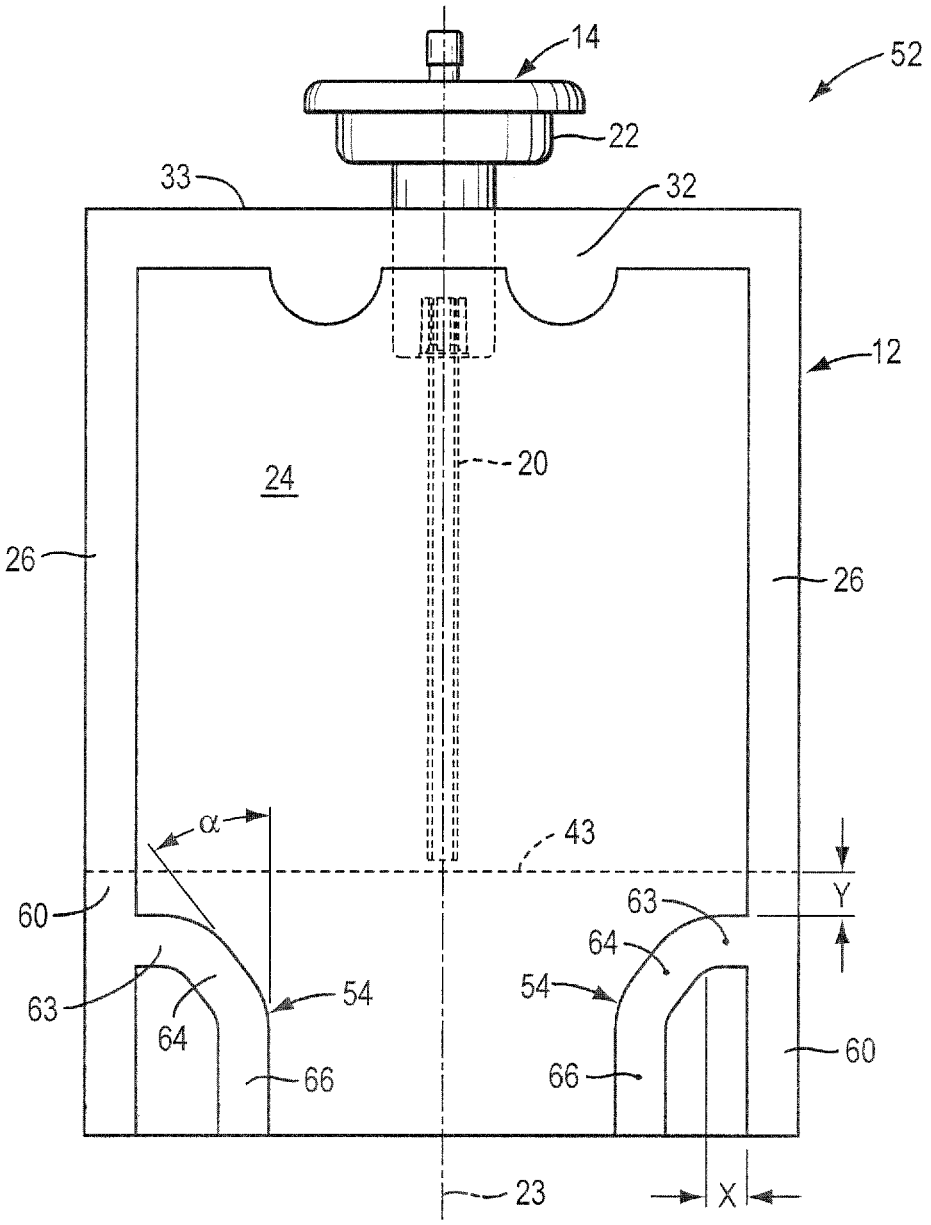
FIG. 3 is a side elevational view of a Bag-On-Valve construction embodying the principles of the present invention.

As illustrated in FIG. 3, the transition segment 63 of each second seal portion of the each corner seal 54 preferably extends horizontally or in substantially perpendicular relationship from the respective first edge seal portion 60. The respective angled linear segment 64 of each second seal portion extends, in turn, at the acute angle "alpha" from the respective one of the transition segments 63 to the respective third vertical seal portion 66.

The part of each second seal portion (63, 64) that is closest to the lower end of a respective one of the longitudinally extending edge seals 26 is spaced from the lower end of the edge seal 26 by a distance Y (FIG. 3) that is preferably between about 3 millimeters and about 5 millimeters. This is the longitudinal directional spacing from the so-called triple weld gusset point on the gusset fold line 43 at which the gusset 42 is joined to each flexible web portions 24. Additionally, it is preferred that each corner seal 54 be configured such that the part of linear segment 64 that is closest to its respective first edge seal portion 60 is spaced from the respective first edge seal portion 60 by dimension X (FIG. 3), preferably about 2 to 5 millimeters.

In the preferred embodiment wherein the transition segment 63 is perpendicular to the first edge seal portion 60, the transition segment 63 has a length corresponding to spacing X. The length of the transition segment 63, in combination with the linear segment 64 and in combination with the spacing of the linear segment 64 from the first edge seal portion 60, contributes to a reduction in stress in the web portions 24 at the triple weld gusset point. The configuration of the segments 63 and 64 in relation to the first edge seal portion 60 creates a relationship which the inventors believe (1) reduces the stress at the triple weld gusset point, and (2) distributes the stress along the vertical seal portion 66 and along the segments 63 and 64.

The present invention has been specifically configured to enhance the strength of the collapsible pouch 12, and in particular, enhance the strength of the pouch at the triple point gusset weld at which the flexible gusset portion 42 is joined to each of the flexible web portions 24 of the pouch. During the development process for the present invention, it was determined that conventional 4-ply laminates, thinner laminates, and laminates with a lower number of layers, as well as foil-less laminates can now withstand standard drop test criteria, where previous designs did not survive, with the standard triple point weld typically failing. By employing the present invention, the cost and the package weight of the Bag-On-Valve pressurized package can now desirably be reduced due to a thinner pouch construction, while providing increased drop test performance, as well as providing foil-less, low-cost Bag-On-Valve pouch options. Additionally, formation of larger packages is possible.

By the improved weld geometry at the triple point weld area of the Bag-On-Valve package embodying the principles of the present invention, the package desirably exhibits improved drop test performance, including vertical and multiple horizontal drop tests as well as 45 degree drop tests.

Current Bag-On-Valve applications typically use a laminated aluminum foil formed into a pouch to hold a product that cannot be exposed to a propellant. This aluminum foil pouch can be made up of various layers of different material, such as polyethylene terephthalate (PET)/aluminum/nylon/polypropylene, or PET/aluminum/nylon/polyethylene, etc. These are typical 4-ply laminate structures, and are standard in the industry.

By the improved gusset weld geometry in accordance with the present invention, thinner laminate structures can now be introduced to lower the cost of the Bag-On-Valve package. The structures can be foil-less, if desired. Such structures can be, for example, 1-ply, 2-ply, or 3-ply structures. The 1-ply structures can have the form of a single layer of PET, nylon, polyethylene (PE), monomers, and other packaging materials. The 2-ply structures can have the form a layer of PET with an adjacent layer of PE, or a layer of nylon with an adjacent layer of PE, or a layer of PET with an adjacent layer of polypropylene (PP), or a layer of nylon and an adjacent layer of PP. Where a PE layer is used, such a PE layer can be either high density polyethylene (HDPE) or low density polyethylene (LDPE) or a blend of both HDPE and LDPE. The 3-ply structure can include layers such as PET/nylon/HDPE. The bonding between the layers can be chemical resistant, solvent based glues that may or may not require heat curing or bonding with hot melt extrusion methods. The HDPE layer can also be comprised of and extruded with multiple layers or blends to improve oxygen and water vapor permeation rates, flexibility, processing ability, etc., with one such example including nylon/ethylene vinyl alcohol (EVOH)/low density polyethylene (LDPE)/high density polyethylene (HDPE).

Previous testing has shown that typical thinner materials used in collapsible pouch structures have not been able to survive standard drop testing. By the improved geometry of the present invention, thinner laminate pouch structures can be introduced into the market place which will now meet and exceed the basic extreme drop tests set by the industry.

Thus, as will be appreciated, advantages offered by the present invention include a new robust gusset design which will improve current 4-ply packaging, which heretofore would not typically pass a horizontal drop test. Notably, structures formed in accordance with the present invention are capable of passing multiple horizontal drop tests, performed successively, without failure. The new robust gusset design can also allow for the use of 1-ply laminate structures, which typically in the past would not pass vertical and horizontal drop testing. It is believed that it will now be possible to pass vertical and multiple horizontal drop tests, performed successively, without failure, thus allowing desired reduction in the cost of a Bag-On-Valve package.

It is believed that the new robust gusset design can also allow for the use of 2-ply laminate structures, where typically in the past such structures could not be configured to pass vertical and horizontal drop testing. The capability of 2-ply laminate structures to pass such testing desirably allows a reduction in the cost of the Bag-On-Valve package.

Similarly, the new robust gusset design will allow the use of 3-ply laminate structures, which typically would not pass vertical and horizontal drop testing. It is believed that it will now be possible for such a 3-ply laminate structure to pass vertical and multiple horizontal drop tests without failure, thus allowing desirable reduction in the cost of the Bag-On-Valve package.

One of the desirable benefits that results from practice of the present invention by use of fewer ply laminates concerns compatibility issues with aggressive products in the Bag-On-Valve pouch. By reduction in the number of pouch layers, with fewer layers of adhesives, and/or thinning of the laminate structure, the present invention now permits more products to be used in a Bag-On-Valve pressurized package, with fewer compatibility issues. Compatibility issues are usually detected by the delamination between layers due to chemical attack, that will lead to leakage or failure of the Bag-On-Valve pouch.

Any aerosol valve can be used with the present invention, such as one having a mounting cup that includes a plastic laminated underside for sealing the collapsible pouch to the cup. Currently, a special body design or adaptor is required for attachment of the pouch to the valve.

Heat sealing or ultrasonic welding may be used to create the new gusset geometry, but it will be understood that for certain applications, use of adhesive, or other sealing techniques, can be employed.

Notably, the present designs allows for a 1 to 2.5% increase in the volume of the collapsible pouch, thus reducing the added stress on the pouch when compared to the current triple point gusset area construction. Changing the typical gusset angle from 45 degrees to the preferred 30 degree angle of the linear segment 64 desirably relatively increases the volume of the pouch.

It should also be understood that while the invention has been described herein in connection with a pressurized unit 50, the invention may find use in other applications that utilize BOV packages.

What is claimed is:

1. A package for containing and dispensing a fluent product, the package comprising:

a fitment body defining a dispensing passage; and a collapsible pouch having a longitudinal axis for containing a fluent product to be dispensed, the pouch defined by two opposing, flexible web portions, and a flexible gusset portion, the fitment body being located at a dispensing end of the pouch and being sandwiched between the flexible web portions, the web portions being joined to define a pair of laterally spaced, longitudinally extending edge seals, and further being joined to each other and to said fitment body to define an end seal extending laterally across the pouch at the dispensing end, the flexible web portions being joined to said flexible gusset portion opposite of said dispensing end of the pouch, a first section of said gusset portion being directly joined to one of said flexible web portions at a pair of laterally spaced corner seals, and a second section of said gusset portion being directly joined to the other of said flexible web portions by another pair of laterally spaced corner seals, each of said corner seals including a first edge seal portion extending from a respective one of said edge seals in parallel relationship to said longitudinal axis, a second seal portion extending inwardly from said first edge seal portion, and a third seal portion extending from said second seal portion either: (1) in parallel relationship to said longitudinal axis and spaced inwardly of the respective first edge seal portion; or (2) outwardly toward the respective first edge seal portion.

2. A package for containing and dispensing a fluent product in accordance with claim 1, wherein said second seal portion of each of said corner seals includes a linear segment that extends at an acute angle relative to said longitudinal axis.

3. A package for containing and dispensing a fluent product in accordance with claim 2, wherein said second seal portion of each of said corner seals includes a linear segment that extends at an acute angle between about 25 to 50 degrees relative to said longitudinal axis.

4. A package for containing and dispensing a fluent product in accordance with claim 2, wherein each of said second seal portions of each of said corner seals has a transition segment that extends in substantially perpendicular relationship from the respective first edge seal portion, the respective linear segment of each of the second seal portions extending at said acute angle from the respective one of said transition segments to the respective third seal portion.

5. A package for containing and dispensing a fluent product in accordance with claim 2, wherein the part of each of said second seal portions that is closest to an end of a respective one of the longitudinally extending edge seals is spaced from said end of said edge seal by a distance Y that is between about 3 millimeters and about 5 millimeters.

6. A package for containing and dispensing a fluent product in accordance with claim 2, wherein the part of said linear segment that is closest to its respective first edge seal portion is spaced a distance X from the respective first edge seal portion wherein the distance X is between about 2 millimeters and about 5 millimeters.

* * * * *